US006425757B1

(12) United States Patent
Chapman et al.

(10) Patent No.: US 6,425,757 B1
(45) Date of Patent: Jul. 30, 2002

(54) PYROLYSIS HEATER WITH PAIRED BURNER ZONED FIRING SYSTEM

(75) Inventors: Paul J. Chapman, Windsor, CT (US); Erwin M. J. Platvoet, Jersey City; Robert J. Gartside, Summit, both of NJ (US)

(73) Assignee: Abb Lummus Global Inc., Bloomfield, NJ (US)

( * ) Notice: Subject to any disclaimer, the term of this patent is extended or adjusted under 35 U.S.C. 154(b) by 0 days.

(21) Appl. No.: 09/880,588

(22) Filed: Jun. 13, 2001

(51) Int. Cl.[7] ..... F27B 9/00

(52) U.S. Cl. ..... 432/146; 432/147; 422/197; 422/198; 422/200; 422/201

(58) Field of Search ..... 432/146, 147, 432/149, 196; 422/197, 198, 200, 201

(56) References Cited

U.S. PATENT DOCUMENTS 3,066,656 A * 12/1962 Hensel ..... 122/240.1
3,385,269 A * 5/1968 Breckenridge ..... 122/240.1
3,554,168 A * 1/1971 Woebcke ..... 122/510
4,324,649 A * 4/1982 Parizot et al. ..... 208/130
4,412,975 A * 11/1983 Parizot et al. ..... 122/235.14
4,959,079 A * 9/1990 Grotz et al. ..... 252/373
5,242,296 A * 9/1993 Tuson et al. ..... 431/10
5,283,049 A * 2/1994 Fluder et al. ..... 110/230
5,763,724 A * 6/1998 Bellet et al. ..... 585/648

* cited by examiner

*Primary Examiner*—Jiping Lu
(74) *Attorney, Agent, or Firm*—Alix, Yale & Ristas, LLP

(57) ABSTRACT

A pyrolysis heater has the inlet sections of the process coils grouped together and the outlet sections of these same process coils also grouped together. High heat liberation hearth burners are located adjacent to the inlet sections of the coils and lower heat liberation burners are located adjacent to the outlet sections. The secondary fuel tips of the burners are inclined toward the adjacent heater wall. The high heat liberation hearth burners adjacent to the inlet coils are arranged in spaced apart pairs with the secondary burner tips of each of the pair being inclined toward the other burner of the pair.

5 Claims, 10 Drawing Sheets

PYROLYSIS HEATER WITH PAIRED BURNER ZONED FIRING SYSTEM

BACKGROUND OF THE INVENTION

The present invention relates to pyrolysis heaters and specifically to an improved burner arrangement to control the heat flux to various sections of the process coils.

A typical pyrolysis heater consists of one or more fireboxes comprising radiant heating sections together with one or more upper convection sections containing feed preheaters. The radiant heating section contains a plurality of radiant process coils suspended in the center plane of the firebox between two radiating walls. The passes of each coil are most often swaged up to gradually larger diameter tubes toward the outlet end. Usually the coils have a number of parallel smaller tubes at the inlet end and fewer larger tubes at the outlet end.

Vertically firing burners located on the hearth or floor of the firebox are used as a heat source inside of many types of pyrolysis heaters. Inside of an ethylene cracking heater, identical hearth burners are spaced on the hearth along both of the long walls of each firebox to provide the high intensity heat release necessary for pyrolysis of the feedstock inside of the process coils. A specific burner design for a particular situation must provide a heat release rate as a function of elevation which is within an acceptable performance envelope. This assures that the process coils receive sufficient heat flux from top to bottom without developing hot spots which promote the formation of deposits inside of the process tubes and reduce the heater availability for production. In a typical pyrolysis heater in an ethylene plant, on the order of eight to ten hearth burners for light feedstocks and perhaps eighteen to twenty for heavy feedstocks are located along each of the refractory walls on the sides of the firebox with the process coil being suspended in the center between the walls. The burners are all of a similar design and they fire upward along the walls at more or less the same rate. This results in the inlet passes and the outlet passes of the process coils being heated at the same flux or heat release rate. Since the gases being treated in the process coils are hotter toward the outlet ends of the coils, these outlet ends are more susceptible to the formation of internal coke deposits. With the inlet and outlet ends of the coils being heated at the same rate, coking is more likely. Further, with hotter process temperatures on the outlet passes and equivalent fluxes, the tube metal temperatures of the outlet passes are normally the highest. In typical radiant coils, the operation is limited by the maximum metal temperature since these expensive alloy tubes operate near their plastic flow limits.

SUMMARY OF THE INVENTION

An object of the invention is to heat the process coils of a pyrolysis heater more efficiently and in a manner which will increase the heat flux to the cooler inlet sections and decrease the heat flux to the hotter outlet sections. The object is to reduce the heat flux at the hotter outlet sections to reduce the tendency for coking while still maintaining the required total heat input for cracking. More specifically, the invention involves grouping the inlet sections of the coils together and grouping the outlet sections together and providing high output and low output burners. The burners are arranged and paired to generate a temperature field that is segregated into hotter and cooler zones properly aligned with the specific sections of the process coils. Even more specifically, the invention involves directing the flames from the burners to achieve the desired temperature zones.

DESCRIPTION OF THE PRIOR ART AND PREFERRED EMBODIMENTS OF THE INVENTION

Figure 1:
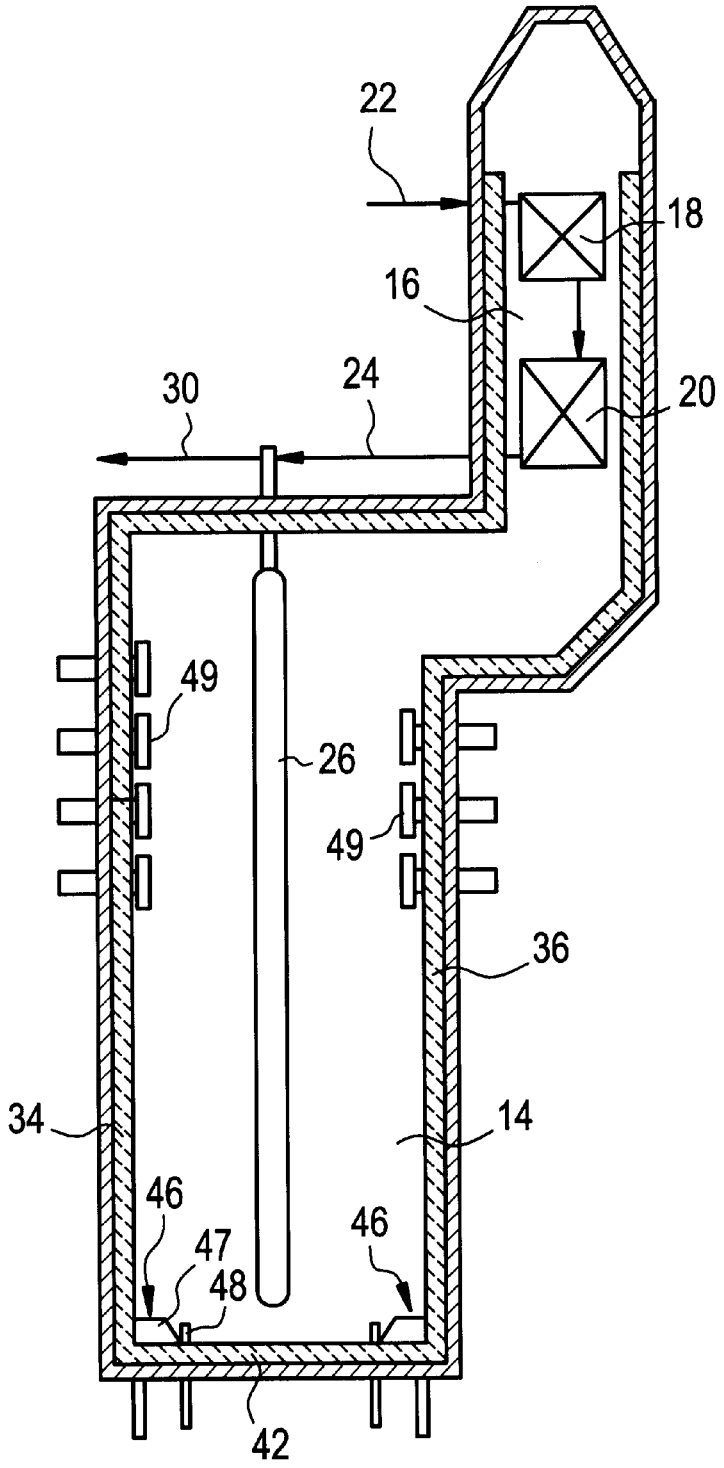
FIG. 1 PRIOR ART
FIG. 1 is a simplified vertical cross-section representation of a typical pyrolysis heater.

Before describing the details of the preferred embodiments of the present invention, a typical prior art pyrolysis heater will be described. FIG. 1 shows a cross section of such a prior art heater. This heater has a radiant heating zone 14 and a convection heating zone 16. Located in the convection heating zone 16 are the heat exchange surfaces 18 and 20 which in this case are illustrated for preheating the hydrocarbon feed 22. This zone may also contain heat exchange surface for producing steam. The preheated feed from the convection zone is fed at 24 to the heating coil generally designated 26 located in the radiant heating zone 14. The cracked product from the heating coil 26 exits at 30.

The radiant heating zone 14 comprises walls designated 34 and 36 and the floor or hearth 42. Mounted on the floor are the vertically firing hearth burners generally designated 46. These burners 46 usually comprise a burner tile 47 through which all of the combustion air is introduced vertically and a series of fuel tips 48 which are also directed into the airstream. The fuel tips 48 are outside of the burner tile 47 for firing secondary fuel but additional fuel tips are located inside of the burner tile, as will be described later, for firing primary fuel. Because of the slow diffusion mixing of the secondary fuel into the combustion zone, referred to as staged firing, the flame reaches its maximum temperature probably half way up the furnace height. In addition to the hearth burners, the wall burners 49 may be included. These are radiant-type burners designed to produce flat flame patterns which are spread across the walls to avoid flame impingement on the coil tubes.

Figure 2:
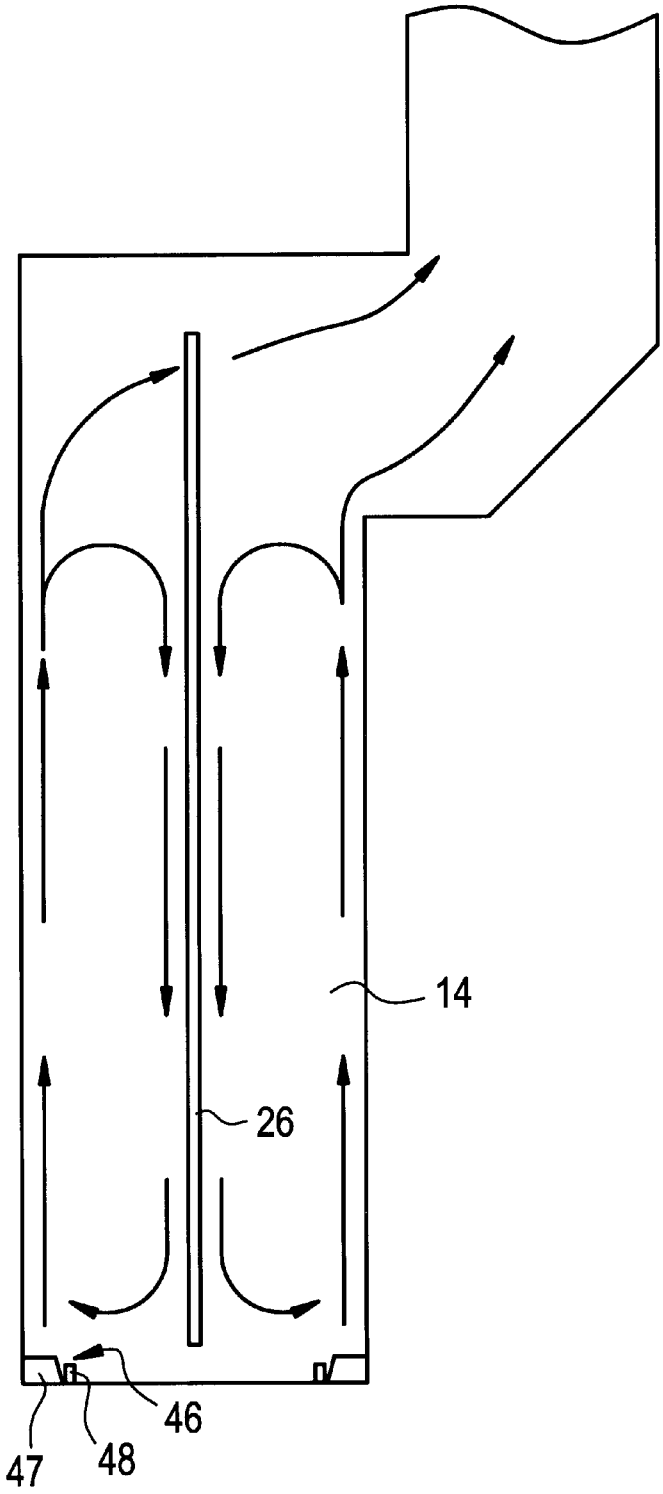
FIG. 2 PRIOR ART
FIG. 2 is a diagram of the typical flow pattern within a firebox of a pyrolysis heater having hearth burners.

FIG. 2 illustrates the flow patterns inside the cracking heater indicating that the hearth burner plumes generate a double vortex inside the heater. Hot gases from the burners run up the walls while a downdraft along the cooler process coils 26 in the center splits at the bottom and feeds back into the burners. Driving forces include high-velocity fuel jets, infiltrated burner air streams and buoyancy. This twin vortex pattern is well organized and efficient, because all of the hearth burners work in concert and fire essentially vertically with no horizontal component and interaction. This causes the individual burner plumes to be rapidly mixed with recirculated gas from the coils and makes the basic system somewhat insensitive to variations in the output of individual burners.

Figure 3:
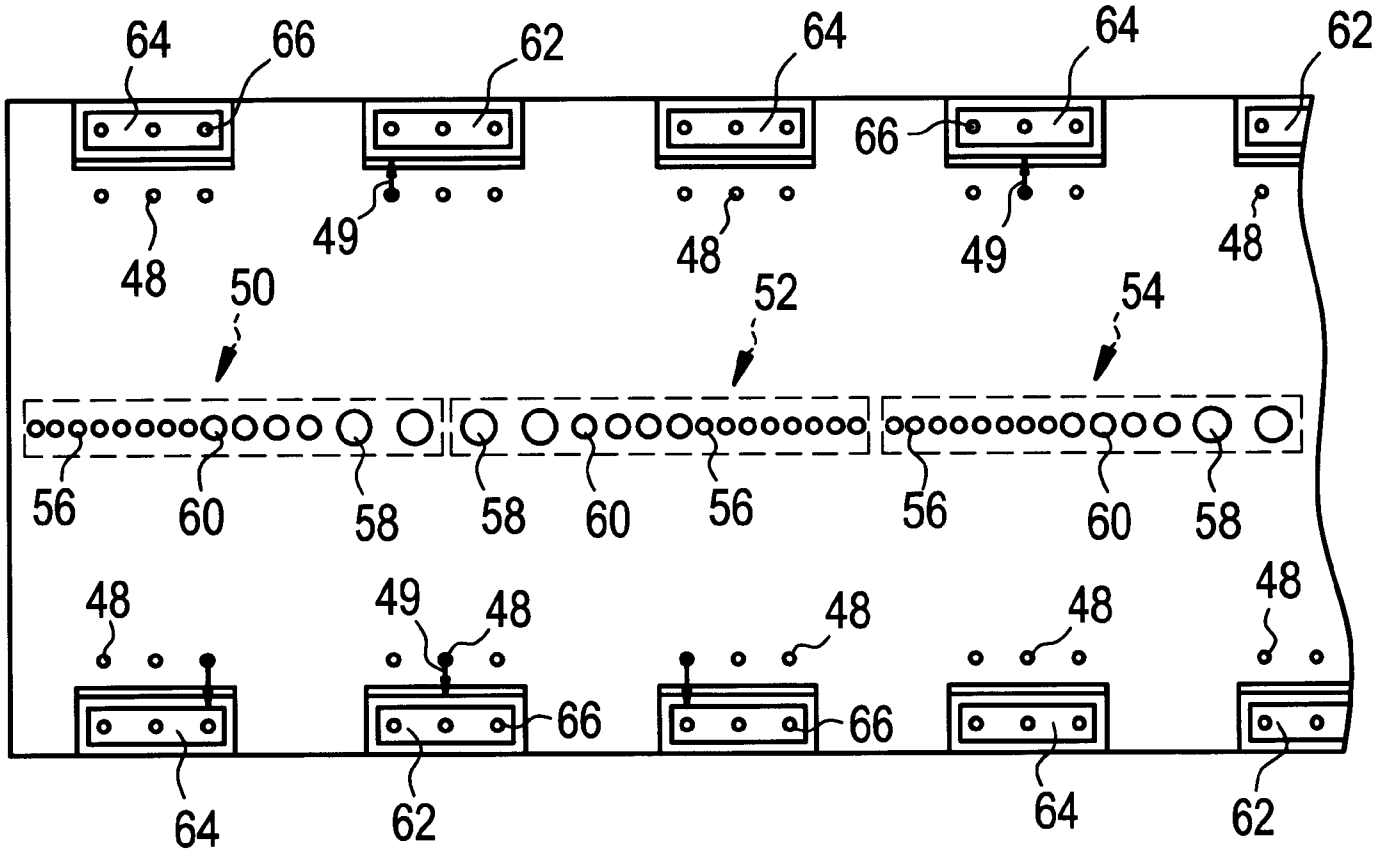
FIG. 3 PRIOR ART
FIG. 3 is a horizontal cross section of the lower portion of a firebox of a prior art pyrolysis heater showing the hearth burners spaced on the hearth along the walls.

FIG. 3 is a horizontal cross section of the lower portion of one half of a firebox showing a prior art zoned-firing burner layout in which some of the burners are normal heat output burners and others are high heat output burners. Three separate coils 50, 52 and 54 are shown in cross section in this half of the firebox with the tubes 56 being the small inlet tubes, the tubes 58 being the large outlet tubes and the tubes 60 being the intermediate sized tubes between the inlet and outlet tubes. In this layout, in an attempt to heat the inlet tubes 56 more than the outlet tubes 58, the hearth burners 62 adjacent to the outlet tubes 58 are normal heat liberation burners with a normal firing rate while the burners 64 adjacent to the inlet tubes 56 are high heat liberation burners with a higher firing rate.

Figure 4A:
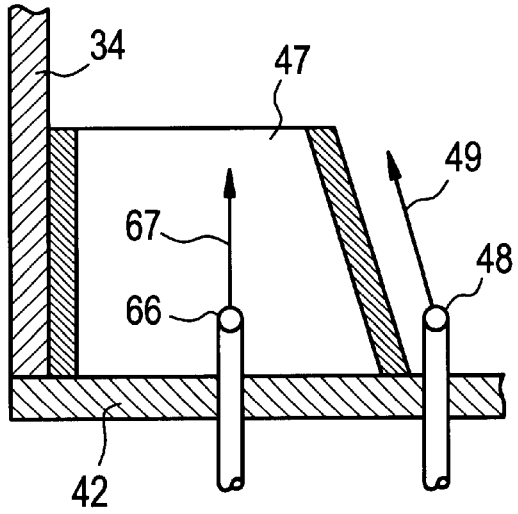
FIG. 4A PRIOR ART
FIG. 4A is a cross-section view of one of the burners of FIG. 3 showing the primary and secondary fuel tips and the firing directions in the plane of the cross section.
Figure 4B:
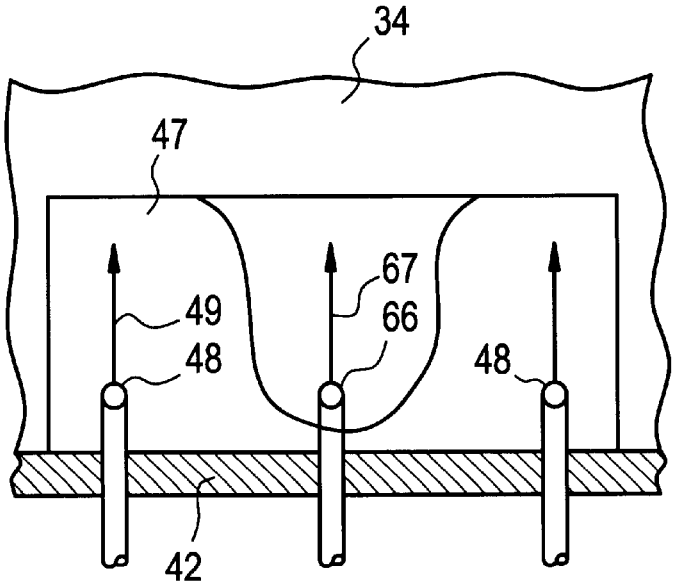
FIG. 4B PRIOR ART
FIG. 4B is a face view of the burner of FIG. 4A showing the firing direction of the secondary fuel tips in the plane parallel to the wall.

FIG. 4A is a cross section of one of the burners 62 or 64 of FIG. 3 while FIG. 4B is a face view of the burner taken from the right of FIG. 4A. The burner comprises the ceramic burner tile 47, secondary fuel tips 48 outside of burner tile 47 and the primary fuel tips 66 inside of the tile. The fuel tips comprise hollow spheres attached to fuel supply conduits with the fuel nozzle comprising a hole drilled or otherwise formed at the appropriate angle through the wall of the sphere. As shown in FIGS. 4A and 4B, the primary fuel tips 66 are directed and fire vertically as indicated by the arrows 67. The secondary fuel tips 48 are directed vertically in the plane of FIG. 4B as shown by the arrows 49, but with a component toward the wall 34 as shown by the arrow 49 in the plane of FIG. 4A to force the flame into the wall. The inclination toward the wall is preferably from 12 degrees to 16 degrees from vertical. High heat liberation burners spread out more than low heat liberation burners, so that from a certain elevation upwards the difference is small.

Figure 5:
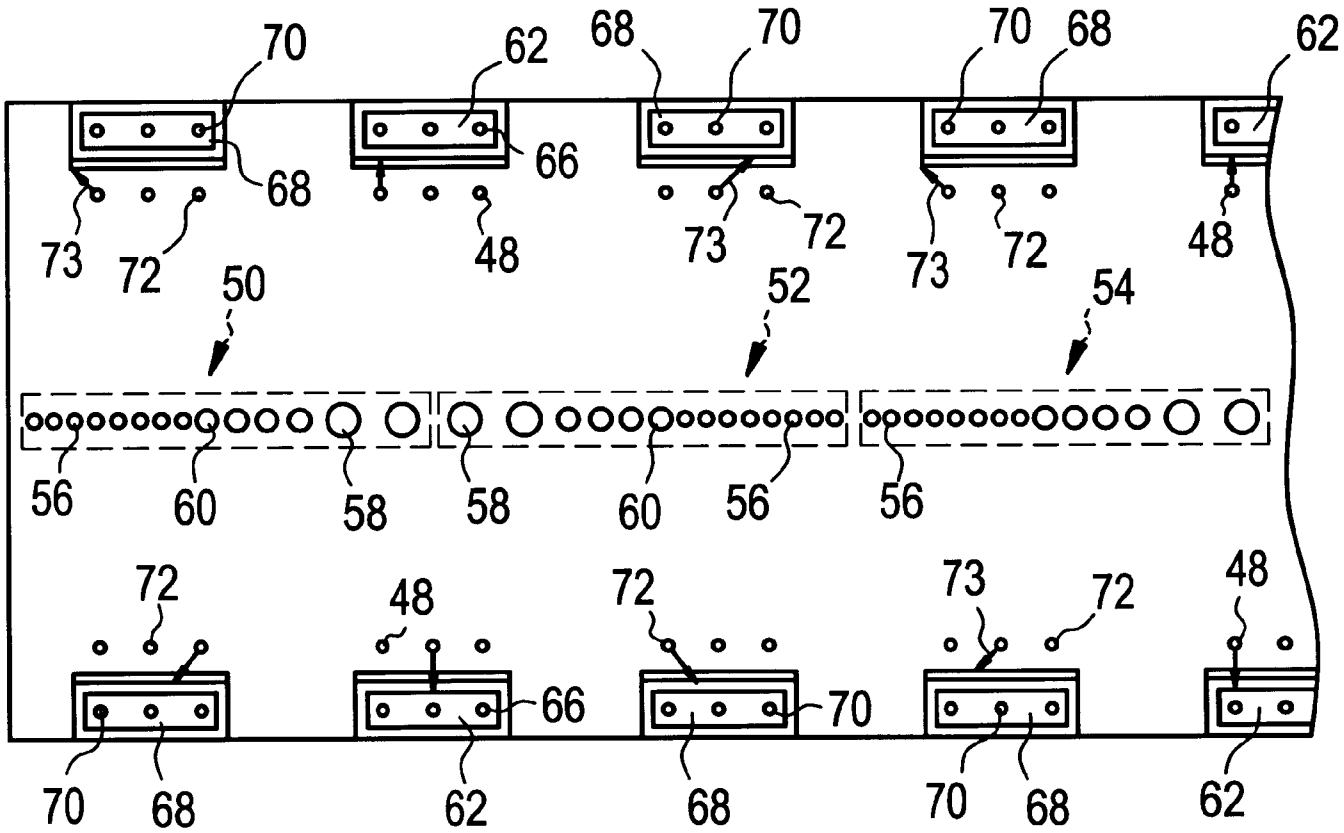
FIG. 5 is a horizontal cross section of the lower portion of a firebox similar to FIG. 3 but showing the burner arrangement of the present invention.

In order to increase the temperature control efficiency of the zoned-firing concept as illustrated in FIG. 3, the present invention couples adjacent high heat liberation burners into pairs. The normal heat liberation burners 62 are unchanged. The layout for this paired-burner, zoned firing system is shown in FIG. 5. This firebox contains the same arrangement of coils 50, 52 and 54 and tubes 56, 58 and 60 as in FIG. 3. It also contains the same type of normal heat liberation hearth burners 62 with these burners being adjacent to and in line with the portions of the coils containing the outlet tubes 58. In order to facilitate this placement of the normal heat liberation burners, the outlet tubes on one coil, such as coil 50, are located adjacent to the outlet tubes on the adjacent coil, such as coil 52.

Figure 6A:
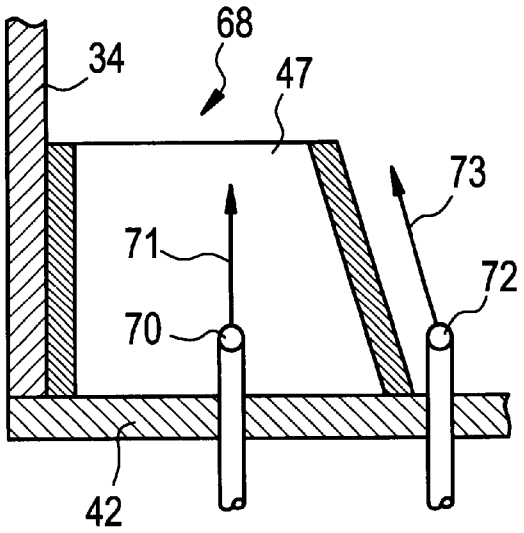
FIG. 6A is a cross-section view of one of the burners of FIG. 5 showing the primary and secondary fuel tips and the firing directions in the plane of the cross section.
Figure 6B:
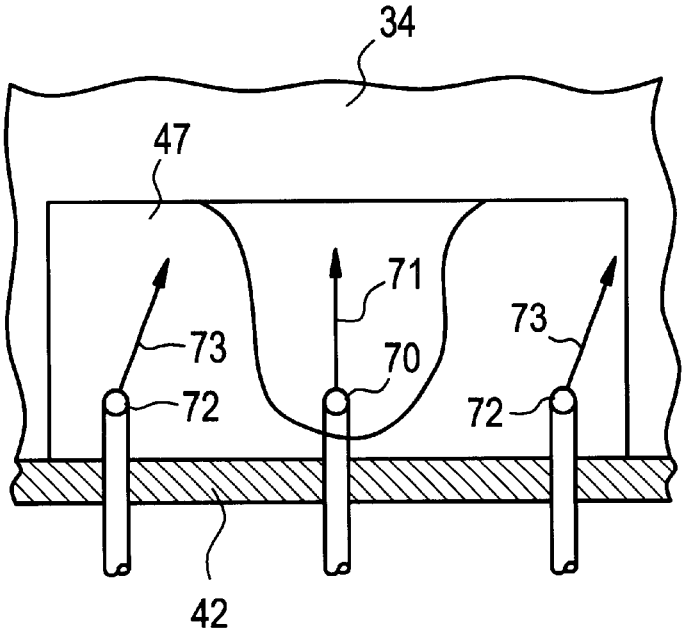
FIG. 6B is a face view of the burner of FIG. 6A showing the firing direction of the primary and secondary fuel tips in the plane parallel to the wall.
Figure 7:
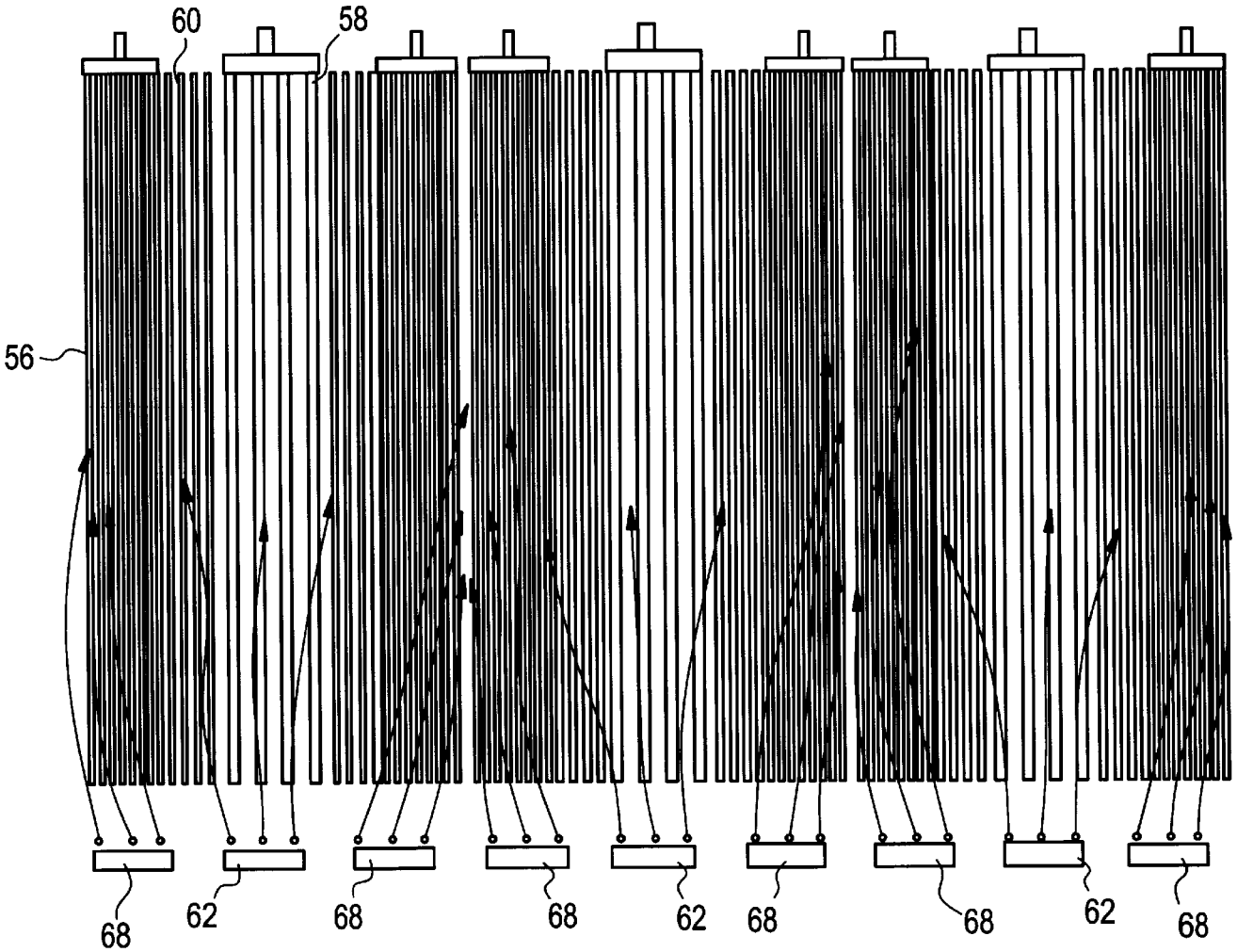
FIG. 7 is a graphical representation of the flow pattern of the flames from the burner arrangement of the present invention.

In the present invention, the high heat liberation burners 68 differ from the high heat liberation burners 64 of FIG. 3. The intent is to generate a temperature field that is segregated into hot and cool zones aligned with the specific sections of the process coils. This is achieved by including lateral components to the burner tips of these paired burners to merge the flames between the paired burners and track the flames up the wall. This lateral component is preferably from 16 degrees to 30 degrees from vertical. The cold air streams emerging from a pair of these burners are then diverted laterally outward toward the burners 62 and aligned with the outlet tubes 58. As seen in FIG. 5 and even more clearly in FIG. 6B, the secondary fuel tips 72 of each of the high heat liberation burners 68 are inclined from the vertical in the direction of the adjacent high heat liberation burners 68 as indicated by the arrows 73. This introduces the lateral component to the flames from the high heat liberation burners causing the flames to merge. The primary fuel tips 70 preferably still fire vertically as shown by the arrows 71. The flow pattern of the flames from the burners is illustrated in FIG. 7.

Figure 8A:
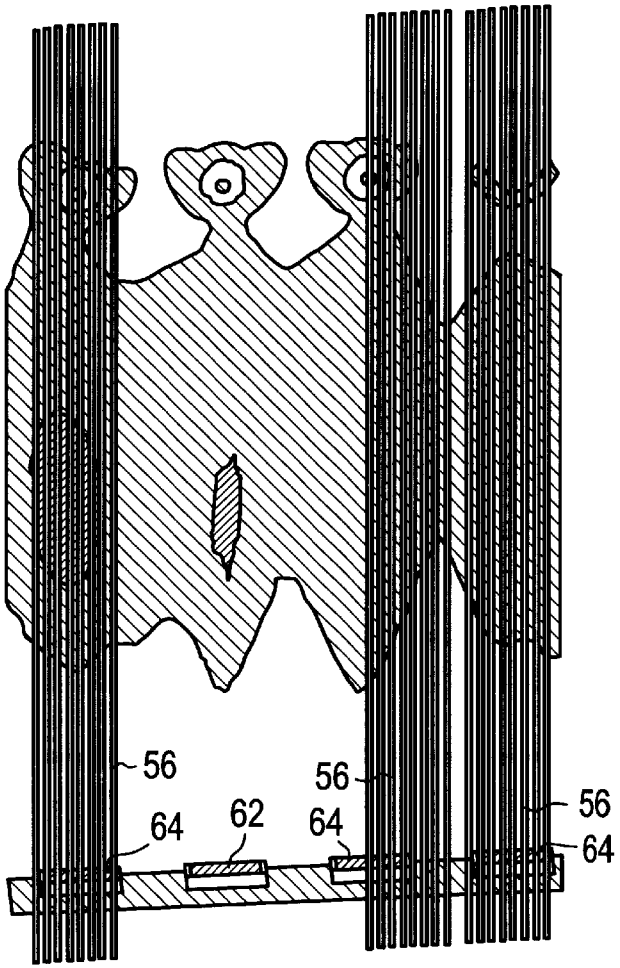
FIG. 8A is gray-scale graphic representation of the radiation intensity distribution for a prior art pyrolysis heater employing a zoned-firing burner layout.
Figure 8A:
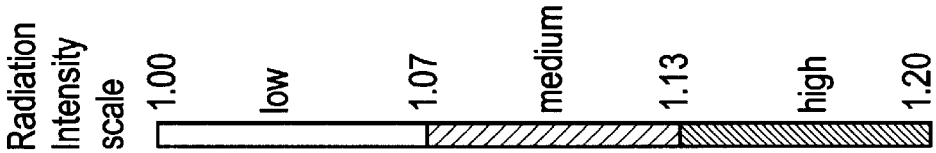
Figure 8B:
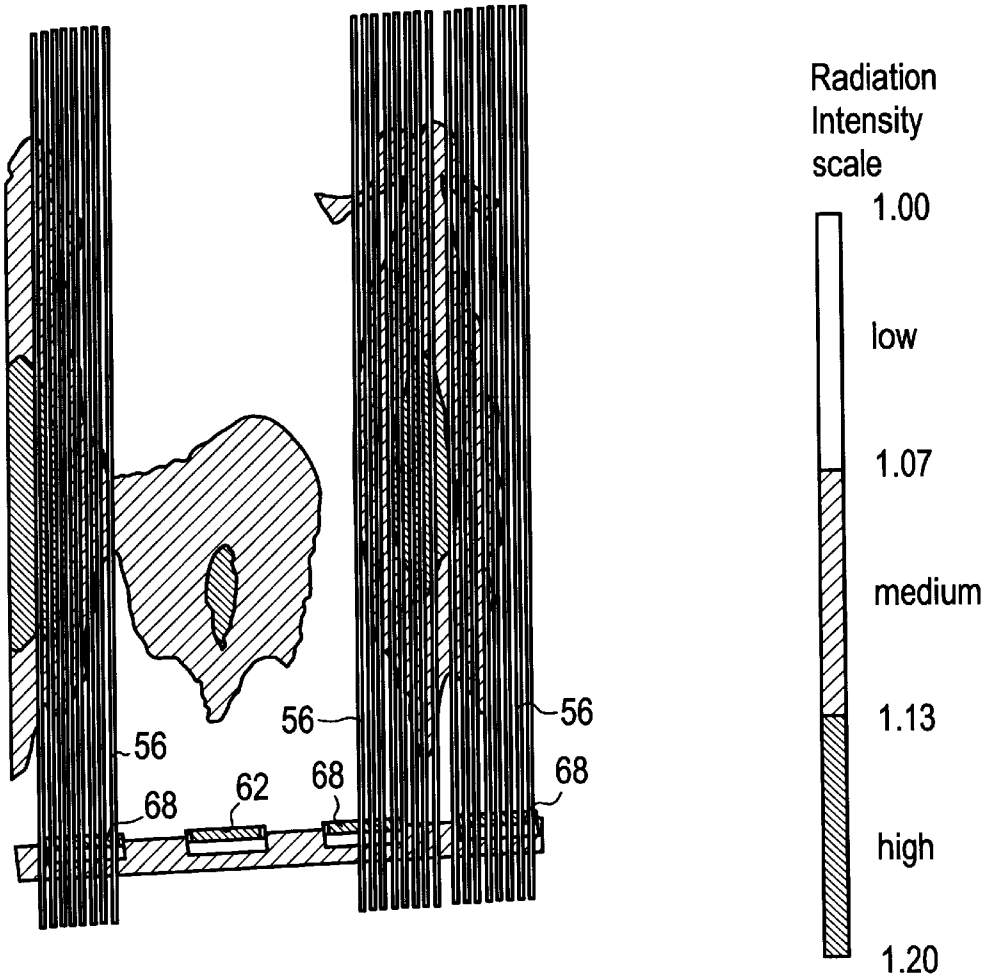
FIG. 8B is a gray-scale graphic demonstration similar to FIG. 7A but showing the radiation intensity for the present invention.
Figure 9:
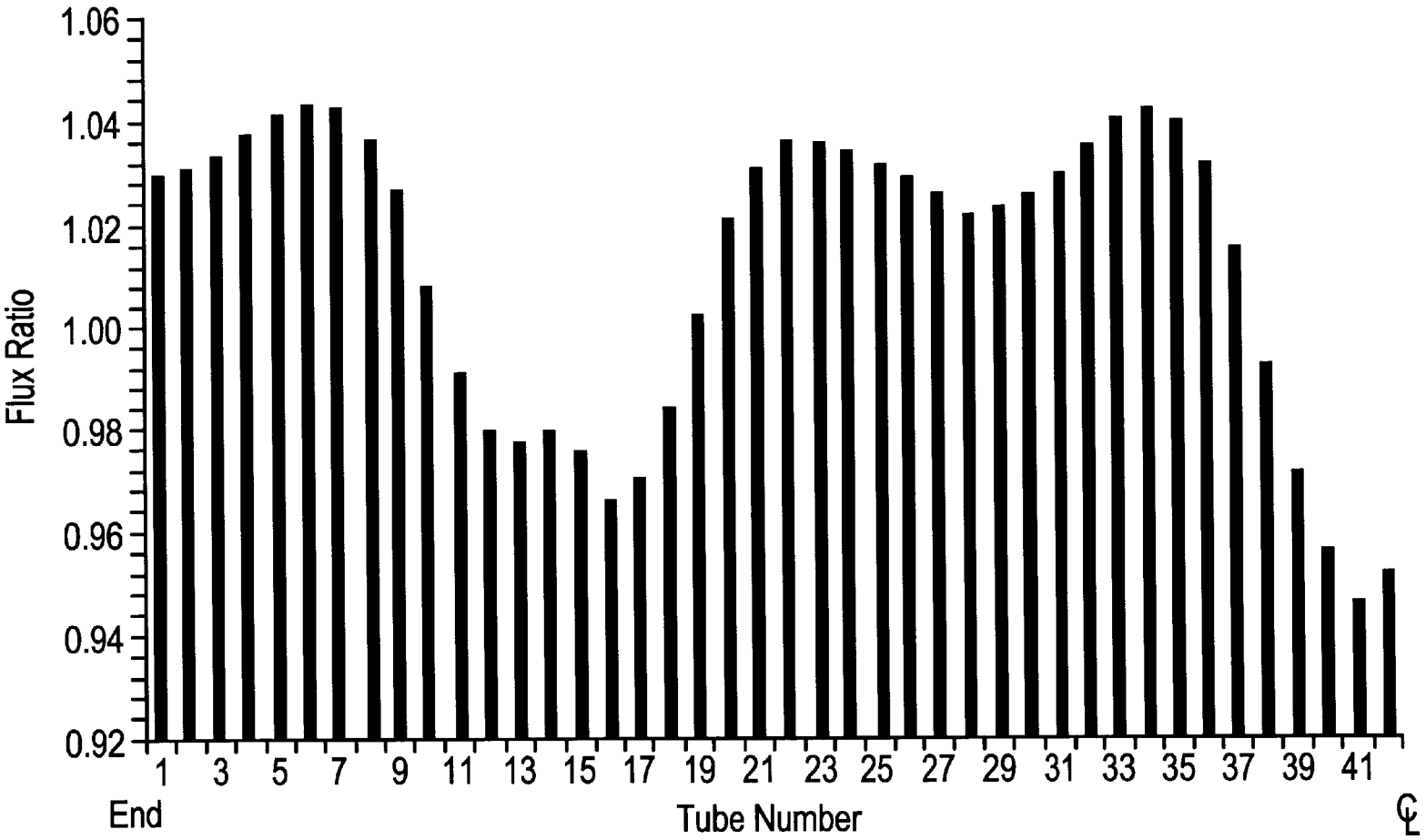
FIG. 9 is a chart showing the ratio of the flux for the present invention to the flux of the prior art.

In this firing mode, the colder gas streams have a tendency to roll around toward the coil and back down to the floor sooner than the plumes generated by the paired high heat liberation burners. The hotter plume formed by the coalescing of the staged burner tips 72 of adjacent high heat liberation burners results in increased heat flux to the first, inlet passes of the coils. These hotter plumes reach higher in the firebox before rolling back around. This puts more high temperature gas against the inlet passes of the coils for a longer period of time and reduces the high temperature gas against the outlet passes. This is illustrated in FIGS. 8A and 8B which compare the radiation intensity of conventional zone firing in FIG. 8A and paired burner zone firing in FIG. 8B. For the purposes of clarity, only the inlet tubes 56 are shown in these two drawings. It can be seen that the overall radiation levels have increased in the areas of the inlet tubes and decreased in the areas of the outlet tubes for the present invention illustrated in FIG. 8B as compared to the prior art in FIG. 8A. At the same time, the colder plumes tend to flow out toward the center and enter the coil downflow zones near the outlet passes of the coil. A similar comparison of the temperature distribution across the unit at various levels also indicates a rather uniform distribution for the prior art whereas the temperatures for the present invention are significantly higher in the areas of the inlet coils than in the areas of the outlet coils. FIG. 9 is a chart showing the ratio of the flux for a paired burner arrangement to the flux of a standard zone firing arrangement for the various tubes of three coils in one half of a six coil unit. It can be seen that the first passes comprising inlet tubes 1 to 9, 21 to 28 and 29 to 36 have over 3% more heat flux. More importantly, the later passes comprising tubes 10 to 19 and 37 to 42 have reduced heat fluxes (2–3% less) and would experience lower peak metal temperatures.

In practice, this allows the ethylene heater designer to increase the overall average flux to the paired zone fired coil since the flux is reduced to the outlet coils thus reducing the fouling and reducing the peak metal temperatures nominally experienced in the outlet coils. By allowing for increased flux with the same maximum metal temperatures, either conversion or capacity or both can be increased. Thus the overall expected increase in capacity or heat input from the invention is the sum of the relative flux differences or over 5% when operated at the same maximum metal temperature.

What is claimed is:

1. A pyrolysis heater for the conversion of hydrocarbons to olefins comprising:

a. a radiant heating zone;

b. a plurality of heating coils each having inlet passes and outlet passes arrayed in a line in said radiant heating zone with the inlet passes of each coil being adjacent to the inlet passes of an adjacent coil and with the outlet passes of each coil being adjacent to the outlet passes of an adjacent coil; and c. a plurality of hearth burners spaced from each other along a line parallel to and spaced from said line of coils, said hearth burners comprising burners of a first firing rate and burners of a second higher firing rate, said burners of a first firing rate being aligned with said outlet passes of said coils and said burners of a second higher firing rate being aligned with said inlet passes of said coils, said burners of a second higher firing rate being arranged in spaced adjacent pairs and each comprising fuel nozzles directed upwardly and inclined at an angle toward said adjacent burner of said pair.

2. A pyrolysis heater as recited in claim 1 wherein said burners of said first and second firing rates are located adjacent to a heater wall and wherein each comprises primary and secondary fuel nozzles and wherein said secondary fuel nozzles are inclined at an angle toward said wall.

3. A pyrolysis heater for the conversion of hydrocarbons to olefins comprising:

a. a radiant heating zone;

b. a plurality of heating coils each having inlet passes and outlet passes arrayed in a line in said radiant heating zone with the inlet passes of at least some of said coils being adjacent to the inlet passes of an adjacent coil and with the outlet passes of at least some of said coils being adjacent to the outlet passes of an adjacent coil; and c. a plurality of hearth burners spaced from each other along a line parallel to and spaced from said line of coils, said hearth burners comprising first hearth burners aligned with said outlet passes of said coils and second hearth burners aligned with said inlet passes of said coils, said first hearth burners each comprising fuel nozzles directed upwardly and said second hearth burners being arranged in spaced adjacent pairs and each comprising fuel nozzles directed upwardly and inclined at an angle toward said adjacent second hearth burner of said pair.

4. A pyrolysis heater as recited in claim 3 wherein said first hearth burners have a lower firing rate than said second hearth burners.

5. A pyrolysis heater as recited in claim 3 wherein said first and second hearth burners are located adjacent to a heater wall and wherein each burner comprises primary and secondary fuel nozzles and wherein said secondary fuel nozzles are inclined at an angle toward said wall.

* * * * *

UNITED STATES PATENT AND TRADEMARK OFFICE

CERTIFICATE OF CORRECTION

PATENT NO. : 6,425,757 B1
DATED : July 30, 2002
INVENTOR(S) : Chapman et al.

It is certified that error appears in the above-identified patent and that said Letters Patent is hereby corrected as shown below:

Title page,
Item [73], Assignee: delete "Abb" and replace with -- ABB --.

Signed and Sealed this

Third Day of December, 2002

JAMES E. ROGAN
*Director of the United States Patent and Trademark Office*